US009333775B2

(12) United States Patent
Kozuma

(10) Patent No.: US 9,333,775 B2
(45) Date of Patent: May 10, 2016

(54) MEDIUM FEED DEVICE, METHOD FOR CONTROLLING MEDIUM FEED DEVICE, AND RECORDING DEVICE

(71) Applicant: SEIKO EPSON CORPORATION, Tokyo (JP)

(72) Inventor: Itaru Kozuma, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/015,123

(22) Filed: Aug. 30, 2013

(65) Prior Publication Data

US 2014/0063163 A1 Mar. 6, 2014

(30) Foreign Application Priority Data

Aug. 31, 2012 (JP) ..... 2012-191463
Jul. 22, 2013 (JP) ..... 2013-151377

(51) Int. Cl.

| | |
|---|---|
| ***B41J 2/01*** | (2006.01) |
| ***B41J 15/04*** | (2006.01) |
| ***B65H 23/032*** | (2006.01) |
| ***B65H 20/08*** | (2006.01) |
| ***B65H 23/02*** | (2006.01) |

(52) U.S. Cl.

CPC ..... *B41J 15/04* (2013.01); *B65H 20/08* (2013.01); *B65H 23/0216* (2013.01); *B65H 23/0326* (2013.01); *B65H 2301/41346* (2013.01); *B65H 2301/4493* (2013.01); *B65H 2403/52* (2013.01); *B65H 2511/112* (2013.01); *B65H 2515/31* (2013.01); *B65H 2515/842* (2013.01); *B65H 2553/414* (2013.01); *B65H 2557/62* (2013.01); *B65H 2701/174* (2013.01); *B65H 2801/15* (2013.01); *B65H 2801/36* (2013.01)

(58) Field of Classification Search

None

See application file for complete search history.

(56) References Cited

U.S. PATENT DOCUMENTS

| | | | | |
|---|---|---|---|---|
| 4,077,579 | A | 3/1978 | Seleski et al. | |
| 4,991,761 | A * | 2/1991 | Gnuechtel et al. | 226/15 |
| 5,619,240 | A * | 4/1997 | Pong et al. | 347/103 |
| 5,781,973 | A * | 7/1998 | Orzel | 26/75 |
| 5,828,818 | A * | 10/1998 | Anzai | 358/1.18 |
| 6,034,784 | A * | 3/2000 | Gatto et al. | 358/1.18 |
| 6,259,868 | B1 * | 7/2001 | Fujii et al. | 399/45 |
| 6,666,600 | B1 * | 12/2003 | Shirota et al. | 400/579 |

(Continued)

FOREIGN PATENT DOCUMENTS

| | | | |
|---|---|---|---|
| EP | 1348660 | A2 | 10/2003 |
| JP | 10008386 | A * | 1/1998 |

(Continued)

OTHER PUBLICATIONS

The Extended European Search Report for the corresponding European Application No. 13182646.3 dated Jun. 29, 2015.

*Primary Examiner* — Kristal Feggins

(74) *Attorney, Agent, or Firm* — Global IP Counselors, LLP

(57) ABSTRACT

The advantage of the invention is to provide a medium feed device and the like for intermittently feeding a recording medium in which meandering can be securely corrected without the occurrence of wrinkles in the recording medium. The medium feed device has a meandering detection sensor which detects position displacement of a recording medium in a width direction, and a control section which controls driving of a width movement unit based on detection results by the meandering detection sensor. The control section stops driving of the width movement unit when stopping feeding of the intermittent feeding.

7 Claims, 4 Drawing Sheets

(56) References Cited

U.S. PATENT DOCUMENTS

| | | | | |
|---|---|---|---|---|
| 8,511,781 | B2 * | 8/2013 | Yamamoto et al. | 347/16 |
| 2002/0000457 | A1 * | 1/2002 | Crowley et al. | 226/31 |
| 2003/0116042 | A1 | 6/2003 | Ohba et al. | |
| 2006/0114281 | A1 * | 6/2006 | Otsuki | 347/19 |
| 2008/0238983 | A1 * | 10/2008 | Takahashi | 347/23 |
| 2011/0242245 | A1 * | 10/2011 | Okazaki | 347/104 |
| 2012/0082499 | A1 * | 4/2012 | Murakami | 400/582 |
| 2013/0175312 | A1 * | 7/2013 | Nakano | 226/15 |

FOREIGN PATENT DOCUMENTS

| | | | |
|---|---|---|---|
| JP | 11-011757 | A | 1/1999 |
| JP | 2007331184 | A * | 12/2007 |

* cited by examiner

MEDIUM FEED DEVICE, METHOD FOR CONTROLLING MEDIUM FEED DEVICE, AND RECORDING DEVICE

CROSS-REFERENCE TO RELATED APPLICATIONS

This application claims priority to Japanese Patent Application No. 2012-191463 filed on Aug. 31, 2012 and Japanese Patent Application No. 2013-151377 filed on Jul. 22, 2013. The entire disclosure of Japanese Patent Application Nos. 2012-191463 and 2013-151377 is hereby incorporated herein by reference.

BACKGROUND

1. Technical Field

The present invention relates to a medium feed device which reels out and feeds a recording medium such as fabric or the like wound in a roll shape, a method for controlling a medium feed device, and a recording device.

2. Background Technology

An inkjet printer has been known which includes a delivery section which feeds fabric along a feed route, a winding-off section which winds off the fabric wound in a roll shape, an intermediate roller for bending and changing the feed route provided on the feed route between the winding-off section and the delivery section, a meandering correction means which moves the fabric in a width direction through the winding-off section, a meandering detection sensor which detects meandering of the fabric fed to the delivery section, and a control means which controls driving of the meandering correction means based on detection results of the meandering detection sensor, in which meandering of the fabric caused by winding displacement of the fabric is corrected (see Patent Document 1).

Japanese Laid-open Patent Publication No. H11-011757 (Patent Document 1) is an example of the related art.

SUMMARY

Problems to be Solved by the Invention

In this type of inkjet printer, in a case of feeding normal fabric having low stretch properties, the fabric can be wound off from the winding-off section (reeling-out section) toward the intermediate roller (route changing roller) while giving tension to the fabric so as to conduct printing in a state where no wrinkles occur, and in a case of feeding fabric having high stretch properties such as a material for stockings, a recording medium can be wound off from the winding-off section toward the intermediate roller after slacking the fabric downward so as not to conduct printing in a state where the fabric is stretched out. Also, in this type of inkjet printer, the delivery section (medium feed mechanism) delivers the fabric usually by intermittent feeding for print line break by the inkjet head.

However, since static friction resistance acts between the fabric and the intermediate roller when stopping feeding of the intermittent feeding by the delivery section, the recording medium on the downstream side with respect to the intermediate roller is hard to move in the width direction compared to the time of feeding of the intermittent feeding in which kinetic friction resistance acts. Further, since no tension is given to the fabric reeled out in a case of feeding the fabric after slacking, the recording medium on the downstream side with respect to the intermediate roller becomes harder to move in the width direction even if the meandering correction means is driven. Therefore, even if the meandering correction means is driven when stopping feeding of the intermittent feeding, the fabric on the downstream side with respect to the intermediate roller can be moved only by a small amount in the width direction. That is, the meandering correction amount with respect to the driving amount of the meandering correction means becomes small when stopping feeding. Consequently, if driving of the meandering correction means is continued when stopping feeding, only the recording medium on the upstream side with respect to the intermediate roller will move in the width direction, resulting in the occurrence of wrinkles in the recording medium (fabric) in the vicinity of the intermediate roller.

The advantage of the invention is to provide a medium feed device for feeding of intermittent feeding in which meandering can be securely corrected without the occurrence of wrinkles in a recording medium, a method for controlling a medium feed device, and a recording device.

Means Used to Solve the Above-Mentioned Problems

A medium feed device according to the invention includes a medium feed mechanism which intermittently feeds a recording medium, a detection section which detects position displacement of the recording medium in a width direction, a width movement section which moves in the width direction, and a control section which controls driving of the width movement section based on detection results by the detection section, in which the control section stops driving of the width movement section when stopping feeding of the intermittent feeding.

A method for controlling a medium feed device according to the invention is a method for controlling a medium feed device including a medium feed mechanism which intermittently feeds a recording medium, a detection section which detects position displacement of the recording medium in a width direction, and a width movement section which moves the recording medium in the width direction, and controlling driving of the width movement section based on detection results by the detection section, in which driving of the width movement section is stopped when stopping feeding of the intermittent feeding.

With this configuration, since driving of the width movement section is stopped when stopping feeding of the intermittent feeding, meandering can be securely corrected without the occurrence of wrinkles in the recording medium.

Preferably, in the above-described medium feed device, the control section controls driving of the width movement section based on detection results by the detection section during a control effective time among a period of stopping feeding of the intermittent feeding.

With this configuration, the width movement section is driven based on detection results of the detection section during a control effective time rather than not driving the width movement section at all when stopping feeding of the intermittent feeding. Consequently, in a case where driving of the width movement section only at the time of feeding of the intermittent feeding does not make the meandering correction amount sufficient, the meandering correction amount can be supplemented.

Here, preferably, the above-described medium feed device further includes an acquisition section which acquires the kind of the recording medium, and the control section has a storing section which stores a control table in which a control effective time is set for each kind of the recording medium.

The control effective time corresponding to the acquired kind of the recording medium is determined by referring to the control table.

If the control effective time for conducting control based on detection results of the detection section when stopping feeding of the intermittent feeding is too long, wrinkles will occur in the recording medium. On the other hand, if the control effective time is too short, the meandering correction amount will become insufficient. Further, since the friction resistance to a route changing roller is different depending on the kind of the recording medium, the meandering correction amount is different depending on the kind of the recording medium even if the driving amount of the width movement section is the same. Therefore, it is desired to obtain an optimum control effective time for each kind of the recording medium. In this respect, according to the present configuration, since the control effective time corresponding to the kind of the recording medium is determined, control based on detection results of the detection section when stopping feeding of the intermittent feeding can be conducted only during the control effective time suitable for the kind of the recording medium.

Here, preferably, the control section stops driving of the width movement section during the whole period of stopping feeding.

Here, preferably, the above-described medium feed device further includes a reeling-out section which reels out the recording medium wound in a roll shape, and the width movement section moves the recording medium in the width direction by moving the reeling-out section in the width direction.

A recording device according to the invention includes the above-described medium feed device, and a printing section which conducts printing to the recording medium fed by the medium feed device.

With this configuration, meandering can be securely corrected without the occurrence of wrinkles in the recording medium by providing the medium feed device. Therefore, printing can be conducted appropriately to the recording medium which has been fed without the occurrence of meandering or wrinkles.

BRIEF DESCRIPTION OF THE DRAWINGS

Referring now to the attached drawings which form a part of this original disclosure.

DETAILED DESCRIPTION OF EXEMPLARY EMBODIMENTS

Hereinafter, an inkjet recording device 1 according to an embodiment of the invention will be explained with reference to the attached drawings. The inkjet recording device 1 conducts printing (textile printing) of patterns or the like by an inkjet method using special dye ink to fabric (original fabric) to be fed and removed by a so-called reel-to-reel method. In the following explanation, a forward and backward feed direction of a recording medium W which is fabric is defined as an X axial direction, a direction orthogonal to the X axial direction is defined as a Y axial direction, and a direction orthogonal to the X axial direction and the Y axial direction is defined as a Z axial direction.

Figure 1:
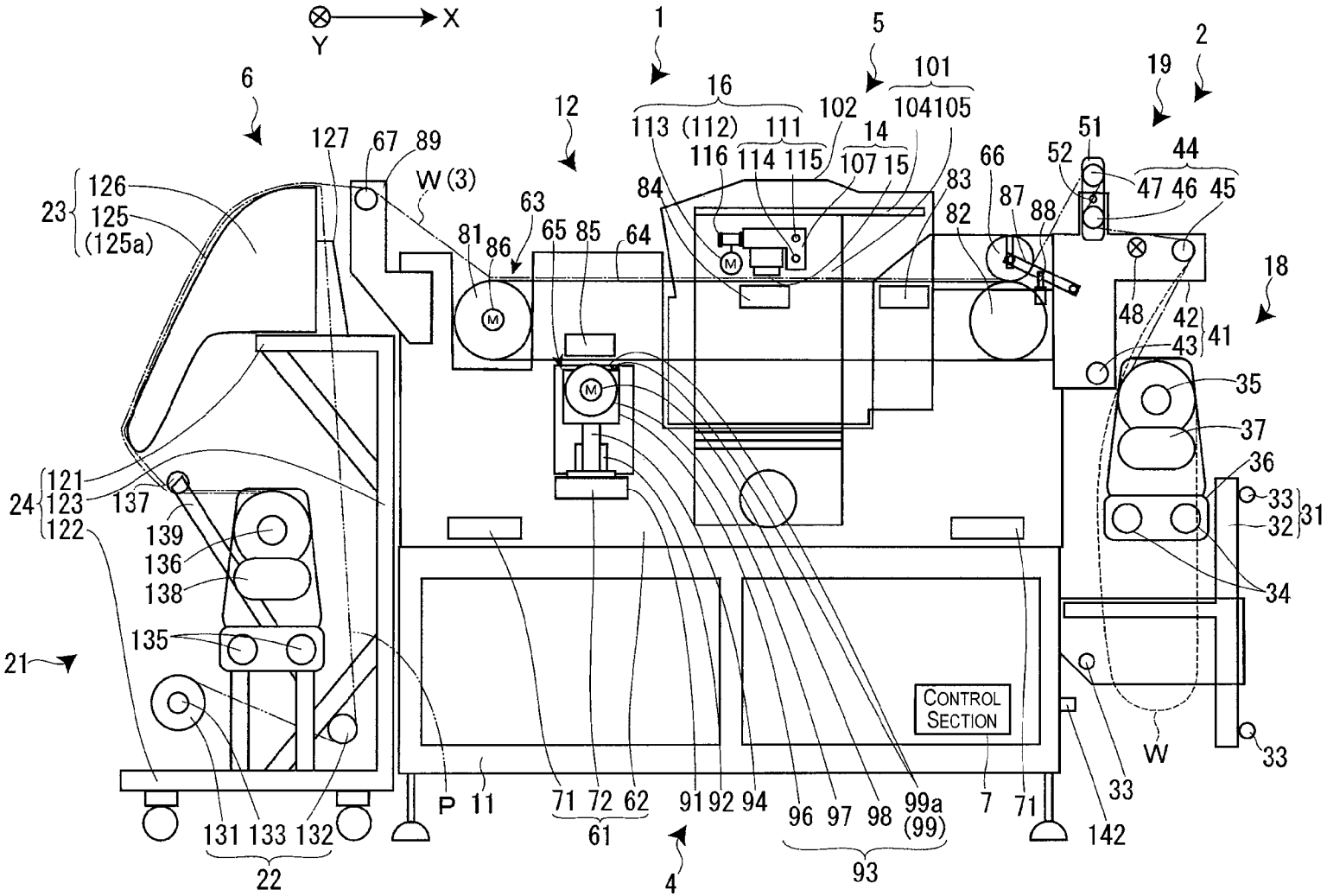
FIG. 1 is a cross-sectional configuration diagram that schematically shows an inkjet recording device according to an embodiment.

FIG. 1 is a cross-sectional configuration diagram of the inkjet recording device 1. As shown in the same drawing, the inkjet recording device 1 has a reeling-out section 2, a device main body 4, a printing section 5, a winding section 6, and a control section 7. The reeling-out section 2 reels out and feeds the recording medium W wound in a roll shape. The device main body 4 feeds the recording medium W, which has been reeled out, along a feed route 3 for printing. The printing section 5 is arranged above the device main body 4, and conducts printing to the recording medium W by an inkjet method in cooperation with the device main body 4. The winding section 6 withdraws the recording medium W, to which printing has been conducted by the printing section 5, by winding it on the downstream side of the feed direction of the device main body 4. The control section 7 conducts overall control of the device of this configuration.

The device main body 4 has a main body base 11 constructed by assembling steel materials, and a medium feed mechanism 12 which is supported by the main body base 11 and intermittently feeds the recording medium W in the X axial direction by belt delivery. The printing section 5 has a carriage unit 14 which has an inkjet head 15, and a head moving mechanism 16 which moves the carriage unit 14 back and forth in the Y axial direction. On the other hand, the reeling-out section 2 has a reeling-out unit 18 which reels out the recording medium W, and a slack take-up unit 19 for taking up the slack of the recording medium W which has been reeled out. The winding section 6 has a winding unit 21 which winds the recording medium W, a slip sheet unit 22 which supplies a slip sheet to the winding unit 21, and a heater unit 23 for vaporizing a solvent (moisture) of dye ink which has soaked into the recording medium W before winding the recording medium W. The winding section 6 is constructed by installing the winding unit 21, the slip sheet unit 22, and the heater unit 23 in a winding section base 24.

The slack of the recording medium W (fabric) reeled out from the reeling-out unit 18 is taken up such that tension is given by the slack take-up unit 19, and then the recording medium W is fed to the medium feed mechanism 12. The recording medium W fed to the medium feed mechanism 12 is delivered by a belt such that the recording medium W adheres to the surface of the belt. While intermittently feeding (sub scanning) the recording medium W in the X axial direction by this belt delivery, the carriage unit 14 moves back and forth in the Y axial direction in synchronization with this, and ink is ejected from the inkjet head 15 (main scanning).

After printing is conducted in this manner, a portion of the recording medium W in which printing has been completed (a portion in which textile printing has been completed) is fed from the medium feed mechanism 12 to the winding section 6. In the winding section 6, a slip sheet P is continuously supplied from the slip sheet unit 22 to the recording medium W fed from the medium feed mechanism 12, and the recording medium W and the slip sheet P which are overlapped with each other are fed to the heater unit 23. In the heater unit 23, the recording medium W is heated together with the slip sheet P, and a solvent (moisture) of dye ink is vaporized. Then, the recording medium W in which textile printing has been completed and a drying process has been conducted is wound by the winding unit 21 together with the slip sheet P.

The reeling-out unit 18 has a reeling-out frame 31, two reeling-out side rod bases 34, and a pair of reeling-out shaft projections 35. The reeling-out frame 31 is constructed of a pair of T-shaped frames 32 on the right and left (in the Y axial direction) fixed to the above-described main body base 11, and a plurality of bar-shaped frames 33 which are bridged between the pair of T-shaped frames 32. The two reeling-out side rod bases 34 are slidably supported by the pair of T-shaped frames 32 in the Y axial direction, and extend in the Y axial direction. The pair of reeling-out shaft projections 35 is slidably supported by the two reeling-out side rod bases 34. A tip end portion of each of the reeling-out shaft projections 35 is formed in a circular truncated cone shape. The tip end portions are respectively fitted into a reeling-out core 141 of the recording medium W in a roll shape (see FIG. 2) by putting the pair of reeling-out shaft projections 35 closer to each other so as to correspond to the width of the recording medium W, so that the pair of reeling-out shaft projections 35 horizontally supports the recording medium W.

The pair of reeling-out shaft projections 35 moves together to the right and left (in the width direction of the recording medium W) through the two reeling-out side rod bases 34 by a width movement unit 36 driven by a motor. When position displacement of the recording medium W in the width direction is detected by a meandering detection sensor 48 described below, the pair of reeling-out shaft projections 35 is slightly moved to the right and left. As a result of this, an edge portion (width edge) of the wound recording medium W becomes an unrolled tip shape, which prevents position displacement of the recording medium W in the width direction with respect to the medium feed mechanism 12, that is, meandering (oblique movement) of the recording medium W in the medium feed mechanism 12 from occurring in a case where winding displacement in the axial direction occurs in the recording medium W.

A rotation unit 37 driven by a motor is incorporated into one of the pair of reeling-out shaft projections 35. The recording medium W is reeled out by reeling out and rotating the pair of reeling-out shaft projections 35 by the rotation unit 37. Further, a reflective light sensor 142 is provided below the reeling-out unit 18 so as to detect presence or absence of the recording medium W reeled out from the reeling-out unit 18.

In the present embodiment, there are two modes including a tension mode and a slack mode. The tension mode is a mode in which the recording medium W is reeled out while giving predetermined tension, and the slack mode is a mode in which the recording medium W is reeled out while making the tension as small as possible. The mode is switched depending on the recording medium W. The tension mode and the slack mode can be switched by a GUI (Graphical User Interface) button on an operation screen (not shown in the drawing) provided in the printing section 5.

The tension mode is for normal fabric (the recording medium W) having low stretch properties. In this case, the control section 7 constructed by a personal computer, for example, controls the rotation unit 37 so as to reel out the recording medium W toward a first roller 45 while giving predetermined tension. More specifically, by torque control of the motor of the rotation unit 37, the control section 7 drives the rotation unit 37 to reel out the recording medium W at the time of a feeding operation of the recording medium W by the medium feed mechanism 12, and the control section 7 drives the rotation unit 37 to slightly wind the recording medium W back at the time of stopping feeding of the recording medium W by the medium feed mechanism 12. As a result of this, the recording medium W is fed in a state where tension is given to the recording medium W between the reeling-out unit 18 and the slack take-up unit 19.

On the other hand, the slack mode is for fabric (the recording medium W) having high stretch properties such as a material for stockings. In this case, the control section 7 controls the rotation unit 37 so as to feed the recording medium W to the slack take-up unit 19 after causing the recording medium W which has been reeled out to slack downward once (in FIG. 1, the slack portion of the recording medium W is shown by a broken line). More specifically, when the slack amount of the recording medium W becomes small in accordance with the feeding operation of the recording medium W by the medium feed mechanism 12 and the light sensor 142 provided below the reeling-out unit 18 detects "absence" of the recording medium W, the control section 7 drives the rotation unit 37 to rotate forward so as to reel out the recording medium W, which increases the slack amount. When the light sensor 142 detects "presence" of the recording medium W, the control section 7 stops driving of the rotation unit 37. With this slack amount control, the recording medium W is fed in a state where the recording medium W between the reeling-out unit 18 and the slack take-up unit 19 appropriately slacks.

The slack take-up unit 19 has a slack take-up frame 41 and a group of rollers 44. The slack take-up frame 41 is constructed of a pair of L-shaped frames 42 on the right and left (in the Y axial direction) fixed to side frames 62 of the medium feed mechanism 12 described below, and a rod frame 43 bridged between the pair of L-shaped frames 42. The group of rollers 44 are rotatably supported on both ends by the pair of L-shaped frames 42. With respect to the group of rollers 44, the first roller 45, a second roller 46, and a third roller 47 are arranged in this order from the upstream side of the feed direction so as to bend the feed route 3 of the recording medium W fed from the reeling-out unit 18 in a plurality of positions. These rollers have a high friction coefficient, respectively.

The recording medium W reeled out from the reeling-out unit 18 makes a U-turn by the first roller 45, and reaches the second roller 46 and the third roller 47. The second roller 46 and the third roller 47 are arranged vertically adjacent to each other, and are rotatably supported by a pair of bearing sections 51 whose end portions are integrally formed. The bearing sections 51 are rotatably supported by the L-shaped frames 42, respectively. An angle adjustment unit 52 for adjusting the vertical arrangement angle of the second roller 46 and the third roller 47 is incorporated into one of the bearing sections 51.

The route of the recording medium W passing through the second roller 46 and the third roller 47 is changed into an "S" shape, and the shape of the "S" curve is changed and adjusted depending on the kind of the recording medium W, so that appropriate tension can be given depending on the recording medium W. Consequently, the recording medium W is fed to the medium feed mechanism 12 by cancelling partial slack or wrinkles. Preferably, the rollers 45, 46 and 47 have a mid-high shape to cause component force directing from the center to the outside to act on the recording medium W. Further, the meandering detection sensor 48 is provided between the first roller 45 and the second roller 46.

The medium feed mechanism 12 has a main body frame 61, a belt delivery unit 63, and a belt cleaner unit 65. The main body frame 61 has the pair of side frames 62 which is mounted and fixed onto the above-described main body base 11 on the right and left (in the Y axial the direction). The belt delivery unit 63 is supported by the pair of side frames 62 and has a delivery belt 64 with no end. The belt cleaner unit 65 is arranged below the belt delivery unit 63. The medium feed mechanism 12 also has a pressing roller 66 and a separating roller 67. The pressing roller 66 faces the belt delivery unit 63 from above on the upstream side. The separating roller 67 is arranged obliquely above the belt delivery unit 63 on the downstream side.

The main body frame 61 has the pair of side frames 62 which is constructed of a thick plate material, and a pair of coupling frames 71 on the front and back (in the X axial direction) which couples the pair of side frames 62. The main body frame 61 is mounted and fixed onto the main body base 11 in the portion of the pair of side frames 62. The main body frame 61 has a support frame 72 which is located between the pair of coupling frames 71 to couple the pair of side frames 62 and supports the above-described belt cleaner unit 65. A notch portion for attaching the belt delivery unit 63 and a notch portion for attaching the printing section 5 are provided appropriately in each of the side frames 62, and an opening portion is also formed to check the belt cleaner unit 65.

The belt delivery unit 63 has a driving pulley 81 which is located on the downstream side of the feed direction, a driven pulley 82 which is located on the upstream side of the feed direction, and the delivery belt 64 with no end which is bridged between the driving pulley 81 and the driven pulley 82. The belt delivery unit 63 has a first guide plate 83, a second guide plate 84, and a third guide plate 85. The first guide plate 83 is located in the vicinity of the driven pulley 82, and guides running of the delivery belt 64. The second guide plate 84 is located right below the printing section 5, and guides running of the delivery belt 64. The third guide plate 85 is located right above the above-described support frame 72, and guides running of the delivery belt 64 which comes around to the back.

The first guide plate 83 and the second guide plate 84 are bridged between the pair of side frames 62 in a state where the surfaces thereof are arranged to be flush (on the same horizontal plane), and serve as part of the main body frame 61. The first guide plate 83 guides the delivery belt 64 immediately after being separated from the driven pulley 82 such that the delivery belt 64 (the upper side thereof) runs horizontally. The second guide plate 84 guides such that no slack occurs in the delivery belt 64 (the upper side thereof) located in a printing area. Therefore, the delivery belt 64 located right above the second guide plate 84 serves as a platen. Further, the third guide plate 85 guides so as to press the delivery belt 64 which receives upthrust force by the belt cleaner unit 65 (the details will be described below).

The driving pulley 81 and the driven pulley 82 are rotatably supported by the pair of side frames 62 through special bearings. A delivery motor 86 for intermittently running the delivery belt 64 is coupled with an axial end of the driving pulley 81. The delivery belt 64 is constructed of a special wide belt having adhesion property (adhesion process) on the outer circumferential surface (front surface), and feeds the recording medium W in the X axial direction by attaching the recording medium W thereto. Consequently, the recording medium W is fed for printing (intermittently fed) right below the printing section 5 without the occurrence of curl.

The pressing roller 66 for attaching the recording medium W fed from the slack take-up unit 19 to the delivery belt 64 is arranged above the driven pulley 82. The pressing roller 66 is rotatably supported by tip end portions of a pair of support arms 87 which are pivotably supported by the pair of side frames 62. Also, the pressing roller 66 has predetermined elasticity and own weight, and presses the recording medium W against the delivery belt 64 right above the driven pulley 82 by the own weight. The pressing roller 66 and the driven pulley 82 serve as a nip roller by sandwiching the delivery belt 64 therebetween, and continuously attach the recording medium W to the running delivery belt 64. Air cylinders 88 for causing the support arms 87 to pivot are coupled in an intermediate position of the support arms 87 respectively, and the pressing roller 66 is separated from the delivery belt 64 by driving the pair of air cylinders 88 in synchronization.

The separating roller 67 for peeling the recording medium W after printing from the delivery belt 64 to feed it to the winding section 6 is arranged obliquely above the driving pulley 81. The separating roller 67 is pivotably supported by a pair of sub frames 89 which extends from the side frames 62. In this case, the separating roller 67 peels the recording medium W relatively from the delivery belt 64 which moves around the driving pulley 81 and comes around to the back. In an actual operation, however, the force of peeling from the delivery belt 64 is different depending on the kind of the recording medium W. Therefore, there are cases depending on the kind of the recording medium W including a case where peeling starts in a position in which the delivery belt 64 starts moving around and a case where peeling starts in a position in which the delivery belt 64 proceeds to some extent. Here, if the position of peeling comes around to the back, there is fear that the recording medium W will be rolled together with the delivery belt 64.

Therefore, in the present embodiment, position detection is conducted with respect to the angle of the recording medium W to be fed from the delivery belt 64 to the separating roller 6, and winding of the winding unit 21 is driven based on detection results of the position detection, so as to prevent the position of peeling from coming around to the back of the delivery belt 64.

The belt cleaner unit 65 is supported by the support frame 72 below the delivery belt 64, and extends in the Y axial direction so as to cross the delivery belt 64. The belt cleaner unit 65 has a unit base 91, an elevator cylinder 92, a cleaner unit main body 93, and a pair of elevator guides 94. The unit base 91 is mounted on the support frame 72. The elevator cylinder 92 is vertically arranged in the unit base 91. The cleaner unit main body 93 is moved up and down by the elevator cylinder 92. The pair of elevator guides 94 guide the cleaner unit main body 93 to move up and down.

The cleaner unit main body 93 has a box-shaped cleaner reservoir 96, a rotation brush 97, a cleaner motor 98, and a wiper 99. The box-shaped cleaner reservoir 96 extends in the Y axial direction, and reserves cleaning liquid. The rotation brush 97 is accommodated in the cleaner reservoir 96. The cleaner motor 98 rotates the rotation brush 97. The wiper 99 relatively scrapes cleaning liquid which adheres to the delivery belt 64. The wiper 99 is constructed of two wiping blades 99*a* which are attached to the inside of the cleaner reservoir 96 and arranged in a "V" shape. Cleaning liquid is scraped by bringing the wiping blades 99*a* into contact with the running delivery belt 64. Cleaning liquid which finally remains in the delivery belt 64 is wiped with waste cloth. Preferably, cleaning liquid is circulated while filtering with respect to an external tank.

Since lint or dust adheres to the delivery belt 64 having adhesion property as time passes, the delivery belt 64 is periodically cleaned by the belt cleaner unit 65. In this cleaning operation, after the cleaner unit main body 93 is moved up to a position in which the rotation brush 97 and the wiper 99 are brought into contact with the delivery belt 64, the delivery belt 64 is caused to run and the rotation brush 97 is caused to rotate in a reverse direction with respect to the running direction. In this instance, the delivery belt 64 is pressed by the above-described third guide plate 85, and is brought into contact with the rotation brush 97 while keeping the horizontal attitude. Consequently, the delivery belt 64 (the adhesive surface thereof) is continuously cleaned by brushing. Preferably, an adhesion process is conducted to the delivery belt 64 after cleaning so as to restore the adhesive force.

The printing section 5 has a printer frame 101, the head moving mechanism 16, the carriage unit 14, and a printer cover 102. The printer frame 101 extends in the Y axial direction so as to straddle the feed route 3 (the belt delivery unit 63). The head moving mechanism 16 is supported by the printer frame 101. The carriage unit 14 is installed in the head moving mechanism 16, and moves back and forth in the Y axial direction. The printer cover 102 covers these. Although they are not shown in the drawings, a cap unit, a cleaning unit, and the like for maintenance of the inkjet head 15 are installed in the printing section 5. A so-called paper gap (work gap) in the printing section 5 is adjusted by moving the entire printing section 5 up and down with respect to the device main body 4 (the medium feed mechanism 12) because the thickness differs depending on various kinds of recording media W.

The printer frame 101 has a beam-shaped sheet-metal frame 104 which extends in the Y axial direction, and a pair of vertical sheet-metal frames 105 which supports the beam-shaped frame 104 on both ends. The printer frame 101 is supported by the above-described side frames 62 in the portion of the pair of vertical frames 105. The printer cover 102 is attached to the printer frame 101.

The carriage unit 14 has the inkjet head 15 and a carriage 107. The inkjet head 15 has lines of nozzles for a plurality of colors for color printing. The carriage 107 retains the inkjet head 15 so as to direct the nozzle surfaces downward. Dye ink of each color to be supplied to each line of nozzles is supplied from a so-called off-carriage ink tank.

The head moving mechanism 16 has a carriage guide 111, a belt transmission mechanism 112, and a carriage motor 113. The carriage guide 111 slidably supports the carriage unit 14 in the Y axial direction with a cantilever structure. The belt transmission mechanism 112 moves the carriage guide 111 back and forth. The carriage motor 113 drives the belt transmission mechanism 112. The carriage guide 111 is constructed of a lower main guide 114 and an upper sub guide 115. The main guide 114 and the sub guide 115 are supported by the above-described pair of vertical frames 105 on both ends. The belt transmission mechanism 112 has a timing belt 116, and part of the timing belt 116 is fixed to the carriage unit 14 (the carriage 107).

When the timing belt 116 is caused to run forward and backward by the carriage motor 113, the carriage unit 14 is guided by the carriage guide 111 and moves back and forth in the Y axial direction. The movement position of the carriage guide 111 is detected by a linear encoder, and dye ink of each color is selectively ejected from the inkjet head 15 based on the detection results and print data. In this manner, printing (textile printing) is conducted to the recording medium W.

The winding section 6 has the winding section base 24, the heater unit 23, the winding unit 21, and the slip sheet unit 22. The winding section base 24 is coupled with the main body base 11 detachably in the X axial direction. The heater unit 23 is supported on the upper portion of the winding section base 24. The winding unit 21 and the slip sheet unit 22 are supported on the lower portion of the winding section base 24. There are two types of winding the recording medium W to which textile printing has been conducted. Specifically, in a case where the recording medium W is thick and offset of ink does not occur, the recording medium W is directly wound. In a case where the recording medium W is thin and offset of ink easily occurs, the recording medium W is wound with a slip sheet P being overlapped. The winding section 6 of the present embodiment has a design which can correspond to either type. Hereinafter, a case of employing the latter type will be explained.

The winding section base 24 has an upper horizontal frame section 121, a lower horizontal frame section 122, and a vertical frame section 123 which couples the upper horizontal frame section 121 and the lower horizontal frame section 122. The winding section base 24 is constructed by assembling extruded shape materials of aluminum vertically and horizontally. The winding section base 24 is detachably coupled with the main body base 11 in the portion of the vertical frame section 123.

The heater unit 23 has a heat release plate 125 which has an arc-shaped heat release surface 125*a*, and a heater 126 which is attached to the inside of the heat release plate 125. The heater unit 23 is attached to the upper horizontal frame section 121 by a right and left fixing members 127 provided in the upper horizontal frame section 121 in a state where the upper portion thereof is mounted on the upper horizontal frame section 121. The upper end portion of the heat release plate 125 is arranged adjacent to the above-described separating roller 67 in a position slightly lower than the separating roller 67. Also, the upper portion of the heat release plate 125 is formed by bending in a downward arc shape so as to change the route of the slip sheet P which is introduced to this portion from below.

The recording medium W passing through the separating roller 67 is overlapped with the slip sheet P, which is fed from below, in the upper end portion of the heat release plate 125, and is fed downward along the arc-shaped outer surface (the heat release surface 125*a*) of the heat release plate 125. The recording medium W and the slip sheet P to be fed in the vertical direction by sliding on the heat release surface 125*a* is continuously heated by the heater 126. The solvent (moisture) of dye ink which has soaked into the recording medium W is vaporized by this heating, and the dye is fixed to the fabric.

The slip sheet unit 22 has a slip sheet roller 131 which reels out the slip sheet P in a roll shape, and a guide bar 132 which changes the route of the slip sheet P which has been reeled out toward the upper end portion of the heat release plate 125. The guide bar 132 is fixed to a portion of a diagonal which couples the lower horizontal frame section 122 and the vertical frame section 123. The slip sheet roller 131 is supported in a front portion of the lower horizontal frame section 122 through a pair of bearing units 133 into which a damping mechanism is incorporated. The slip sheet P is reeled out without the occurrence of slack by the pair of bearing units 133.

Similarly to the above-described reeling-out unit 18, the winding unit 21 has two winding side rod bases 135, and a pair of winding shaft projections 136. The two winding side rod bases 135 are supported in a back portion of the lower horizontal frame section 122, and extend in the Y axial direction. The pair of winding shaft projections 136 is slidably supported by the two winding side rod bases 135. The winding unit 21 has a tension roller 137 which is located in the feed route 3 between the lower end portion of the heat release plate 125 and the pair of winding shaft projections 136, and gives tension to the recording medium W and the slip sheet P.

A tip end portion of each of the winding shaft projections 136 is formed in a circular truncated cone shape. The tip end portions are respectively fitted into a winding core for winding the recording medium W by putting the pair of winding shaft projections 136 closer to each other so as to correspond to the width of the recording medium W, so that the pair of winding shaft projections 136 horizontally supports the recording medium W. A rotation unit 138 driven by a motor is incorporated into one of the pair of winding shaft projections 136, and the recording medium W and the slip sheet P are wound at the same time by rotating the pair of winding shaft projections 136 for winding. As described above, the rotation unit 138 is controlled based on the angle detection of the recording medium W to be fed to the separating roller 67 in the vicinity of the separating roller 67.

The tension roller 137 is roratably supported in the tip end portions of a pair of pivot arms 139 which is pivotably supported in the back portion of the lower horizontal frame section 122. The tension roller 137 contacts the slip sheet P by rotation among the recording medium W and the slip sheet P which are wound by the winding core, and pivotally biases against the recording medium W and the slip sheet P downward by its own weight. As a result of this, appropriate tension is given to the recording medium W and the slip sheet P, and the recording medium W and the slip sheet P are wound by the winding core while being wound tightly.

Figure 2:
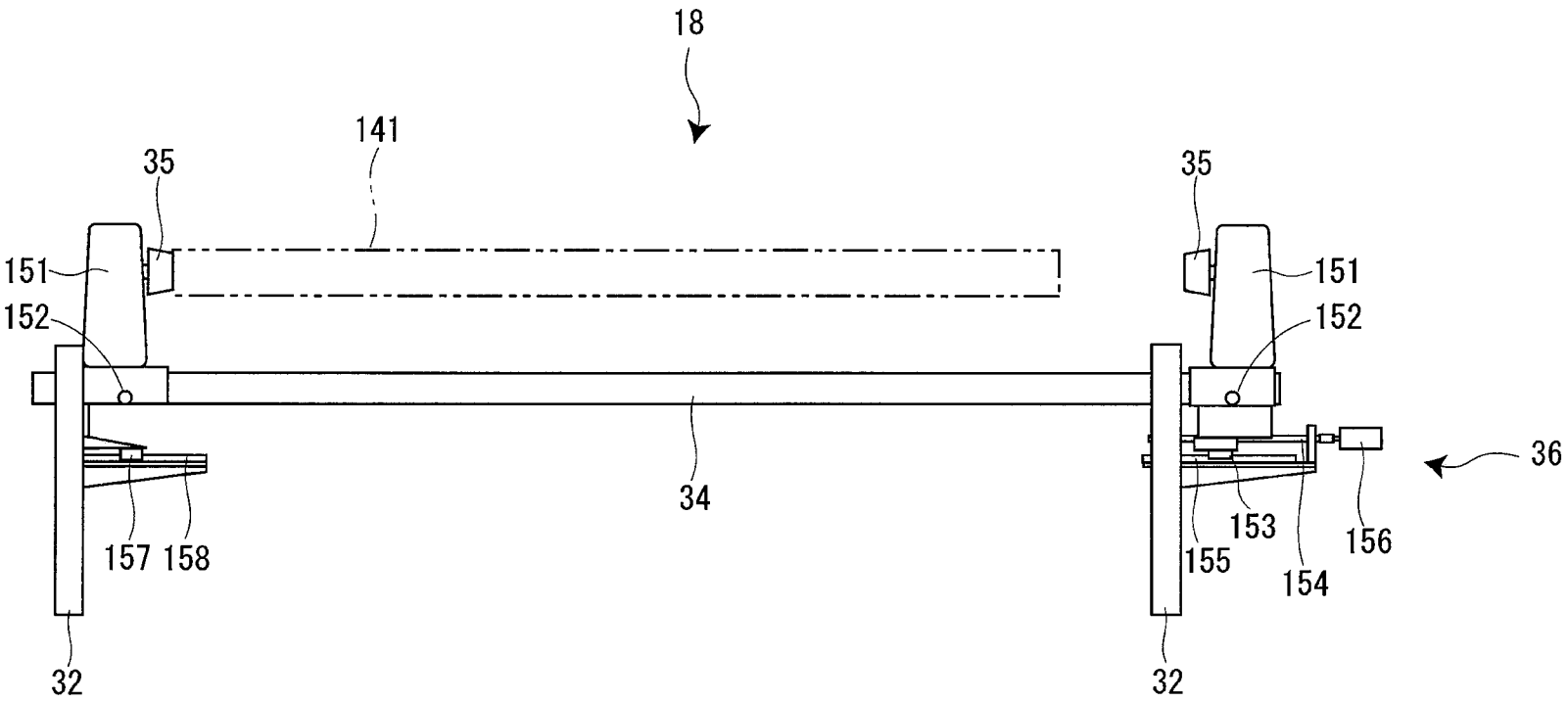
FIG. 2 is a diagram of a reeling-out unit of the inkjet recording device viewed from the upstream side.

The reeling-out unit 18 will be explained in detail with reference to FIG. 2. As described above, the reeling-out unit 18 has the reeling-out frame 31, the two reeling-out side rod bases 34, the pair of reeling-out shaft projections 35, and the width movement unit 36. The reeling-out frame 31 is constructed of the pair of T-shaped frames 32 on the right and left, and the plurality of bar-shaped frames 33 (not shown in FIG. 2). The two reeling-out side rod bases 34 (only one is shown in FIG. 2) are slidably supported by the pair of T-shaped frames 32 in the Y axial direction, and extend in the Y axial direction. The pair of reeling-out shaft projections 35 is slidably supported by the two reeling-out side rod bases 34 through a pair of shaft projection support sections 151 described below. The width movement unit 36 moves the pair of reeling-out shaft projections 35 to the right and left (in the width direction of the recording medium W) through the two reeling-out side rod bases 34.

Further, the reeling-out unit 18 has the pair of shaft projection support sections 151 and a lock/unlock handle 152. The pair of shaft projection support sections 151 on the right and left is slidably supported by the two reeling-out side rod bases 34 in the Y axial direction, and pivotally supports the pair of reeling-out shaft projections 35 in a rotatable manner. The lock/unlock handle 152 locks/unlocks each of the shaft projection support sections 151 in an optional position on the reeling-out side rod base 34.

The width movement unit 36 has a right slider 153, a ball screw 154, a right linear guide 155, and a width movement motor 156. The right slider 153 is provided on the right end side of the two reeling-out side rod bases 34, and slidably supports the two reeling-out side rod bases 34 in the Y axial direction. The ball screw 154 moves the right slider 153. The right linear guide 155 guides movement of the right slider 153. The width movement motor 156 rotates the ball screw 154 forward and backward. Further, the width movement unit 36 has a left slider 157 and a left linear guide 158. The left slider 157 is provided on the left end side of the two reeling-out side rod bases 34, and slidably supports the two reeling-out side rod bases 34 in the Y axial direction. The left linear guide 158 guides movement of the left slider 157. When the width movement motor 156 is driven, the ball screw 154 is rotated forward and backward, and the two reeling-out side rod bases 34 move in the Y axial direction through the right slider 153.

In the reeling-out unit 18 configured above, first, an operator places it into an unlock state by operating the lock/unlock handle 152. With this, the pair of shaft projection support sections 151 is made slidable with respect to the two reeling-out side rod bases 34. The pair of shaft projection support sections 151 is put closer to each other so as to correspond to the length of the reeling-out core 141 around which the recording medium W is wound, and the tip end portions of the pair of reeling-out shaft projections 35 are fitted into the reeling-out core 141, respectively. As a result of this, the recording medium W wound around the reeling-out core 141 (medium roll Wr, see FIG. 3) is supported horizontally with respect to the pair of shaft projection support sections 151 through the pair of reeling-out shaft projections 35. Subsequently, the reeling-out unit 18 is placed into a lock state by operating the lock/unlock handle 152. Consequently, the pair of shaft projection support sections 151 is fixed to the two reeling-out side rod bases 34. In this state, the recording medium W can be reeled out.

Then, when the width movement unit 36 (the width movement motor 156) is driven based on detection results of the meandering detection sensor 48 described below, the pair of shaft projection support sections 151 moves together to the right and left along the right linear guide 155 and the left linear guide 158 through the two reeling-out side rod bases 34. Consequently, the recording medium W supported by the pair of shaft projection support sections 151 moves in the width direction thereof (to the right and left). The movable range of the pair of shaft projection support sections 151 (medium roll Wr) by the width movement unit 36 is ±100 mm to the right and left, for example.

Figure 3:
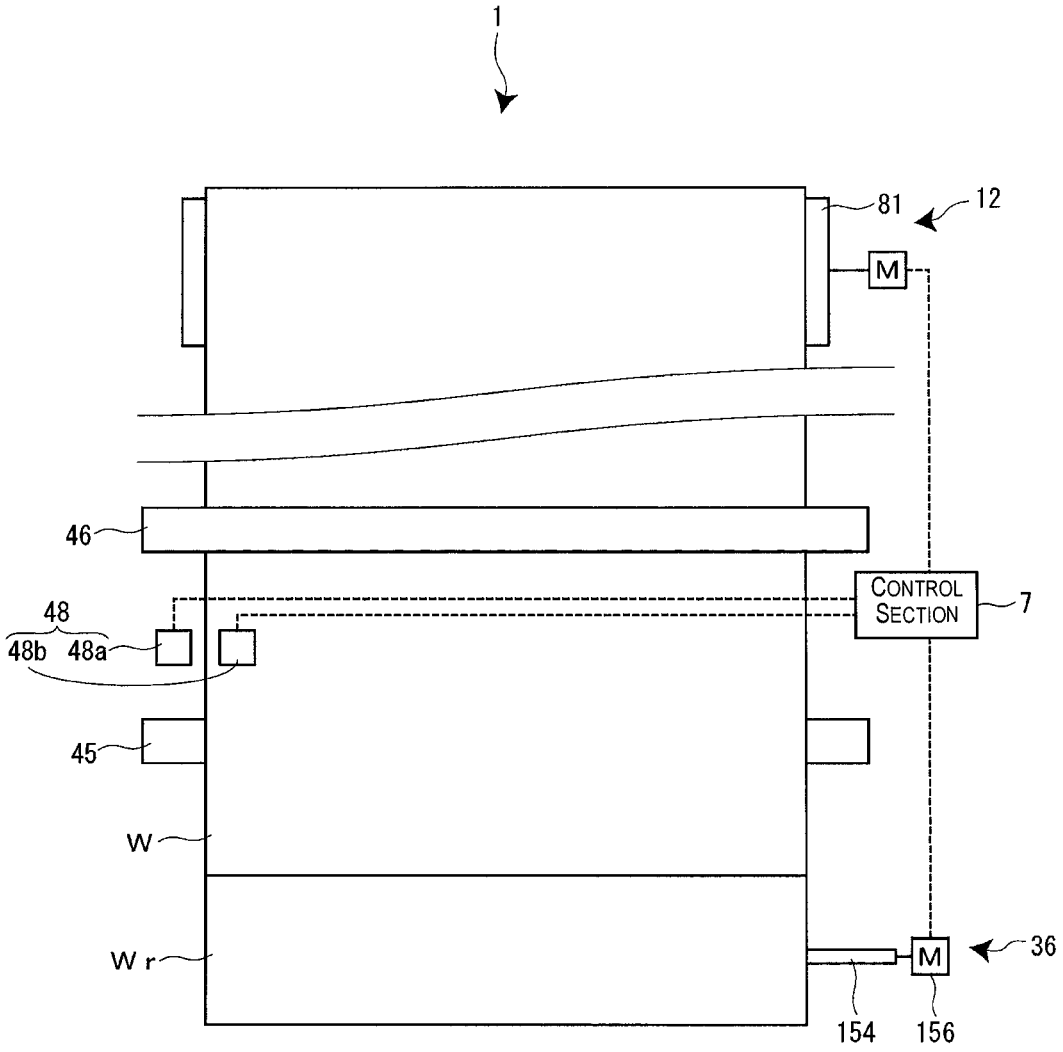
FIG. 3 is a diagram of the circumference of the reeling-out unit of the inkjet recording device viewed from above.
Figure 4:
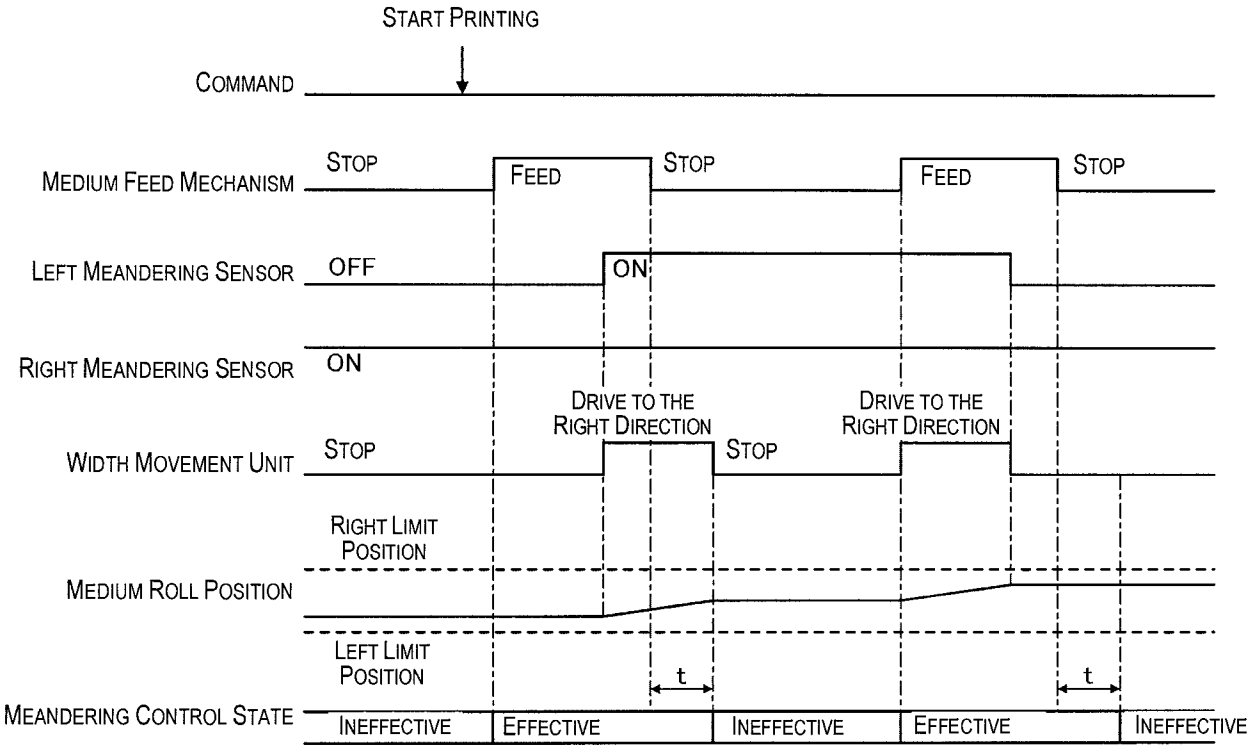
FIG. 4 is a timing chart that shows meandering control in the inkjet recording device.

With reference to FIG. 3 and FIG. 4, meandering control to the recording medium W in the inkjet recording device 1 will be explained. As described above, the meandering detection sensor 48 is provided between the first roller 45 and the second roller 46 of the slack take-up unit 19 so as to be located in the left width end of the recording medium W to be fed and detect the position displacement (meandering) of the recording medium W in the width direction. Here, the position of the meandering detection sensor 48 in the Y axial direction can be changed corresponding to the width of the recording medium W.

As shown in FIG. 3, the meandering detection sensor 48 has a left meandering sensor **48*a* and a right meandering sensor 48*b* which are constructed of a reflective photosensor, respectively. The detection results of the left meandering sensor 48*a* and the right meandering sensor 48*b* are output to the control section 7, respectively. In a case where the left width end of the recording medium W is located between the left meandering sensor 48*a* and the right meandering sensor 48*b* (normal state), the left meandering sensor 48*a* is OFF and the right meandering sensor 48*b* is ON (hereinafter, also shown by "left/right:OFF/ON"). In this case, the control section 7 does not drive the width movement unit 36, and does not move the recording medium W. On the other hand, in a case where the left width end of the recording medium W is displaced on the left meandering sensor 48*a* side, the state becomes "left/right:ON/ON". In this case, the control section 7 drives the width movement unit 36 so as to move the recording medium W to the right. Also, in a case where the left width end of the recording medium W is displaced on the right meandering sensor 48*b* side, the state becomes "left/right: OFF/OFF". In this case, the control section 7 drives the width movement unit 36 so as to move the recording medium W to the left. The interval between the left meandering sensor 48*a* and the right meandering sensor 48*b*** (meandering allowance range) can be set as appropriate corresponding to the required printing accuracy and the like. Preferably, however, it is approximately 1 mm, for example.

As shown in FIG. 4, when a command to "start printing" is issued by an operator on the operation screen, the inkjet recording device 1 starts a printing operation. Here, when starting the printing operation, the left width end of the recording medium W is located between the left meandering sensor 48*a* and the right meandering sensor 48*b*, the state is "left/right:OFF/ON". Then, the control section 7 which has received the command to "start printing" starts intermittent feeding of the recording medium W by controlling the medium feed mechanism 12, and starts control to the width movement unit 36. Although the time of each feeding of the intermittent feeding depends on the distance of sub scanning (the width of print line break), it is 0.2 second in the present embodiment. Also, although the time of each stop of feeding of the intermittent feeding depends on the distance of main scanning (the width of an image), it is approximately 2 seconds.

Since the friction resistance between the recording medium W and the first roller 45 when stopping feeding of the intermittent feeding, the recording medium W on the downstream side with respect to the first roller 45 is hard to move in the width direction. Therefore, even if the width movement unit 36 is driven when stopping feeding of the intermittent feeding, the recording medium W on the downstream side with respect to the first roller 45 can be moved only by a small amount in the width direction. Consequently, if driving of the width movement unit 36 is continued when stopping feeding of the intermittent feeding, there is fear that the medium roll Wr might reach a movement limit position by the width movement unit 36 without correcting meandering of the recording medium W. In such a case, since the meandering detection sensor 48 still keeps detecting meandering, the width movement unit 36 tries to move the medium roll Wr beyond the movement limit position, which will cause a situation in which the width movement unit 36 cannot be controlled or wrinkles occur in the recording medium W. According to the present embodiment, therefore, the following meandering control is conducted.

As shown in FIG. 4, the control section 7 controls driving of the width movement unit 36 based on detection results of the meandering detection sensor 48 during the whole period of feeding of the intermittent feeding. However, when feeding of the intermittent feeding is stopped, driving of the width movement unit 36 is controlled based on detection results of the meandering detection sensor 48 only during a predetermined control effective time "t", and driving of the width movement unit 36 is stopped other than the control effective time "t". In other words, when feeding of the intermittent feeding is stopped, meandering control is effective during the control effective time "t", and meandering control is ineffective other than the control effective time "t"

More specifically, in accordance with the start of feeding of the recording medium W by the medium feed mechanism 12, when the position of the recording medium W is displaced to the left and the left meandering sensor 48*a* is turned from OFF to ON ("left/right:ON/ON"), the control section 7 drives the width movement unit 36 to move the recording medium W to the right. Then, when feeding of the intermittent feeding is stopped, the control section 7 drives the width movement unit 36 to move the recording medium W to the right based on detection results of the meandering detection sensor 48 ("left/right:ON/ON") only during the control effective time "t". Then, when the control effective time "t" ends, the control section 7 stops driving of the width movement unit 36 irrespective of detection results of the meandering detection sensor 48. Then, back to feeding of the intermittent feeding, the control section 7 controls driving of the width movement unit 36 based on detection results of the meandering detection sensor 48, and stops driving of the width movement unit 36 when the left meandering sensor 48*a* is turned from ON back to OFF ("left/right:OFF/ON").

As described above, according to the present embodiment, when feeding of the intermittent feeding is stopped, the control section 7 controls driving of the width movement unit 36 based on detection results of the meandering detection sensor 48 only during the control effective time "t", and driving of the width movement unit 36 is stopped other than the control effective time "t". Therefore, the width movement unit 36 will not move the medium roll Wr beyond the movement limit position. Consequently, it is possible to prevent the width movement unit 36 from becoming out-of-control, and also prevent wrinkles from occurring in the recording medium W.

Also, in the present embodiment, when feeding of the intermittent feeding is stopped, the control section 7 drives the width movement unit 36 based on detection results of the meandering detection sensor 48 during the control effective time "t". As a result of this, in a case where driving of the width movement unit 36 only at the time of stopping feeding of the intermittent feeding does not make the meandering correction amount sufficient, the meandering correction amount can be supplemented. Consequently, when feeding of the intermittent feeding is stopped, meandering can be securely corrected without making the width movement unit 36 out-of-control.

Since the friction resistance to the first roller 45 is different depending on the kind of the recording medium W (the material, with or without pretreatment, or the like) or the type of the delivery method (the tension mode or the slack mode), even if the driving amount of the width movement unit 36 is the same, the meandering correction amount is different depending on the kind of the recording medium W. As the kind of the recording medium W, various materials can be listed including materials for clothes such as silk, wool, nylon, polyester and materials for building products such as paper, coated paper, wallpaper, curtain, tarpaulin, or the like. Also, since the delivery amount of the recording medium at the time of intermittent feeding or the time of each feeding of the intermittent feeding is different depending on the type of the print mode (a high quality mode or a high speed mode), even if the recording medium W is the same, the meandering correction amount will be different depending on the driving amount of the width movement unit 36, that is, the print mode. It is thus preferable to obtain an optimum control effective time "t" in advance by evaluation for each of the kind of the recording medium W, the type of the delivery method, the type of the print mode, and the like. Then, a control table, in which the control effective time "t" obtained by such evaluation is set for each of the kind of the recording medium W, the type of the delivery method, or the type of the print mode, is stored in a storing section of the control section 7. Then, an operator inputs the kind of the recording medium W, the type of the delivery method, the type of the print mode, or the like on the operation screen before starting printing. The control section 7 acquires this input information, and determines the control effective time "t" by referring to the control table stored in the storing section. In this manner, the optimum control effective time "t" at the time of printing is determined, and thus, control based on detection results of the meandering detection sensor 48 when stopping feeding of the intermittent feeding can be conducted only during the appropriate control effective time "t".

Also, as described above, the time of each feeding of the intermittent feeding is 0.2 second in the present embodiment. However, there are cases where the time of feeding will become longer than 0.2 second if a space is inserted between an image and an image or depending on the print mode. In a case where the time of each feeding is longer than a predetermined reference time (for example, 0.5 second), it is preferable to stop driving of the width movement unit 36 during the whole period of stopping feeding immediately after such feeding. In a case where the time of each feeding is longer than the predetermined reference time, the medium roll Wr moves closer to the movement limit position in some cases. Therefore, it is possible to prevent the medium roll Wr from moving beyond the movement limit position by stopping driving of the width movement unit 36 during the whole period of stopping feeding immediately after such feeding. Also, in a case where the time of feeding is longer than the predetermined reference time, meandering of the recording medium W can be corrected sufficiently by driving the width movement unit 36 based on detection results of the meandering detection sensor 48 only during the period of feeding. Therefore, there is no need to drive the width movement unit 36 when the feeding is stopped.

In the present embodiment, the control effective time "t" is set at the beginning of the period of stopping feeding of the intermittent feeding (immediately after feeding). However, the invention is not limited to this, and the control effective time "t" can be set at the end of the period of stopping feeding (immediately before next feeding) or in the middle of the period of stopping feeding. The meandering correction amount at the time of stopping feeding can be increased by setting the control effective time "t" at the beginning of the period of stopping feeding as the present embodiment. This is because the recording medium W and the first roller 45 continue to move for a slight amount of time by inertia even when driving of the medium feed mechanism 12 is stopped, and the effect of correcting meandering can be expected for the slight amount of time. Further, in a case where meandering of the recording medium W can be corrected sufficiently only by driving the width movement unit 36 at the time of feeding of the intermittent feeding, the control effective time "t" does not need to be set at the time of stopping feeding of the intermittent feeding, and driving of the width movement unit 36 can be stopped during the period of stopping the feeding. The present embodiment is configured such that the wound recording medium W to be fed to the meandering detection sensor 48 is moved in the width direction by slightly moving the pair of reeling-out shaft projections 35 to the right and left by the width movement unit 36 provided in the reeling-out unit 18. The invention is not limited to this, and it can be configured such that the recording medium W to be fed to the meandering detection sensor 48 is moved in the width direction by sandwiching the recording medium W to be fed to the meandering detection sensor 48 between two rollers and controlling movement of the rollers in the width direction. In such a case, the recording medium W does not need to be supported by the reeling-out unit 18 in a state of being wound, and it can be possible to use a mechanism in which fabric is reeled out in a state of being folded, for example. In the present embodiment, the recording medium W is fabric. However, the invention is not limited to this, and the same effect can be achieved with paper, coated paper, a film, or the like.

What is claimed is:

1. A medium feed device comprising:

a medium feed mechanism which intermittently feeds a recording medium;

a printing section which conducts printing to the recording medium;

a detection section which detects position displacement of the recording medium in a width direction;

a width movement section which prevents position displacement of the recording medium in the width direction; and a control section which controls driving of the width movement section based on detection results by the detection section, wherein the control section stops driving of the width movement section when stopping feeding of the intermittent feeding during the printing.

2. The medium feed device according to claim 1, wherein the control section controls driving of the width movement section based on detection results by the detection section during a control effective time among a period of stopping feeding of the intermittent feeding.

3. The medium feed device according to claim 2 further comprising:

an acquisition section which acquires the kind of the recording medium, wherein the control section has a storing section which stores a control table in which a control effective time is set for each kind of the recording medium, and the control effective time corresponding to the acquired kind of the recording medium is determined by referring to the control table.

4. The medium feed device according to claim 1, wherein the control section stops driving of the width movement section during the whole period of stopping feeding.

5. The medium feed device according to claim 1 further comprising:

a reeling-out section which reels out the recording medium wound in a roll shape, wherein the width movement section moves the recording medium in the width direction by moving the reeling-out section in the width direction.

6. A recording device comprising:

the medium feed device according to claim 1; and a printing section which conducts printing to the recording medium fed by the medium feed device.

7. A method for controlling a medium feed device comprising a medium feed mechanism which intermittently feeds a recording medium, a printing section which conducts printing to the recording medium; a detection section which detects position displacement of the recording medium in a width direction, and a width movement section which prevents position displacement of the recording medium in the width direction, and controlling driving of the width movement section based on detection results by the detection section, wherein driving of the width movement section is stopped when stopping feeding of the intermittent feeding during the printing.

* * * * *